United States Patent [19]

Palamides et al.

[11] Patent Number: 4,870,807

[45] Date of Patent: Oct. 3, 1989

[54] METHOD AND APPARATUS FOR PACKAGING PRINTED MATTER

[75] Inventors: Sesto Palamides, Stuttgart; Aldo Palamides, Renningen; Stefano Palamides, Stuttgart, all of Fed. Rep. of Germany

[73] Assignee: Palamides GmbH, Renningen, Fed. Rep. of Germany

[21] Appl. No.: 153,064

[22] Filed: Feb. 8, 1988

[30] Foreign Application Priority Data

Feb. 18, 1987 [DE] Fed. Rep. of Germany ..... 3705169

[51] Int. Cl.[4] ..... B65B 13/20

[52] U.S. Cl. ..... 53/528; 53/529; 53/540; 53/586

[58] Field of Search ..... 53/529, 540, 553, 586, 53/528, 530; 414/31, 43, 48, 91; 198/462

[56] References Cited

U.S. PATENT DOCUMENTS

| | | | |
|---|---|---|---|
| 2,606,669 | 8/1952 | Morrison | 414/91 X |
| 3,040,488 | 6/1962 | Winkler | 53/586 X |
| 3,683,758 | 8/1972 | Feldkamper | 414/91 X |
| 3,766,708 | 10/1973 | Kubo | 53/529 |
| 4,264,255 | 4/1981 | Saro | 414/48 X |
| 4,547,112 | 10/1985 | Steinhart | 414/31 |
| 4,569,622 | 2/1986 | Buck | 414/43 X |
| 4,667,953 | 5/1987 | Hirakawa | 198/462 X |
| 4,720,229 | 1/1988 | Steinhart | 414/31 |

FOREIGN PATENT DOCUMENTS

| | | | |
|---|---|---|---|
| 1908053 | 2/1969 | Fed. Rep. of Germany . | |
| 7812828 | 4/1978 | Fed. Rep. of Germany . | |
| 2178130 | 3/1973 | France . | |
| 589597 | 5/1957 | Italy | 414/48 |
| 227045 | 2/1942 | Switzerland . | |

*Primary Examiner*—John Sipos

*Attorney, Agent, or Firm*—Poms, Smith, Lande & Rose

[57] ABSTRACT

Copies, preferably folded or stitched copies of printed matter, are taken over from a preceding station by means of a loading device, and transferred to a stacking device. The copies are compressed over their full surface before they reach the said stacking device, scaled up by pushing them a certain way one upon the other, and accumulated in synchronism with the operation of the said stacking device. The copies are taken over from the stacking device by a transfer device in the compressed condition, in the form of a total stack. The loading device, the stacking device, the transfer device and the said packaging device are united to one structural unit.

16 Claims, 4 Drawing Sheets

METHOD AND APPARATUS FOR PACKAGING PRINTED MATTER

The present invention relates to a method for packaging printed matter comprising the steps of receiving copies of the preferably folded, glued or stitched printed matter arriving from a preceding station, by means of a loading device, and supplying them to a stacking device where the individual copies are aligned and counted; arranging the individual copies in partial stacks; turning the partial stacks successively by 180° about their vertical axis and arranging them in the form of a total stack; and supplying the total stacks so formed finally to a packaging unit where they are pressed together and enclosed in wrapping means.

The invention further relates to an apparatus for packaging preferably folded, glued or stitched copies of printed matter by means of loading means adapted for receiving the copies from a preceding station, comprising stacking means following the loading device and transfer means for transferring stacked copies from the stacking means to a packaging unit.

A method and an apparatus of this type have been known before from the leaflet entitled "Beck Packautomaten DB 2".

The known packaging device serves for aligning, stacking and packaging printed matter after the latter has passed stitching or folding machines, several individual devices forming one packaging system.

In the case of the known packaging device, loose copies of the printed matter are supplied one by one, via a conveyor belt, to a cross-stacker where they are aligned, counted and formed into partial stacks. Several such partial stacks are stacked upon each other, each rotated by an angle of 180°, to form a total stack. The aligned, but loosely arranged total stack is discharged from the cross-stacker via a conveyor belt and fed to a packaging machine where the total stack is compressed and banded or sealed into a film.

As the copies are supplied to the cross-stacker continuously, one by one and in loose condition, the folded, stitched or glued copies may curve or get displaced relative to each other. In particular during transfer from the cross-stacker to the packaging unit in the form of a loose stack the copies may get dislodged relative to each other so that an oblique stack, maybe even with broken edges, may be formed during the subsequent compressing and banding or welding operation. Further, the method of feeding the copies one by one provides the additional disadvantage that the crossstacker must operate at a very high speed if jams are to be avoided.

As is generally known, the cross-stacking operation consists of collecting, for example, a given number of copies in a pre-storaged unit in order to transfer them to a final storage unit in the form of a partial stack. For transferring the partial stack to the final storage unit one opens, for example, flaps provided on the pre-storage unit to permit the stack to drop by gravity into the final storage unit. Now, when the pre-storage unit is loaded continuously, individual copies may get directly into the final storage unit when the flaps are still open, without having been stored first in the pre-storage unit, so that the size of the partial stack can no longer be determined. This provides the disadvantage that the total stack may be composed of partial stacks of different thickness, and total stacks formed in this manner are especially sensitive to shocks and instable. Now, it is the object of the present invention to improve a method and a device of the described type in such a manner that the copies can be collected, aligned and packed in the form of a stack of high density, within very limited space.

This object is achieved according to the invention, as regards the method described above, by the steps of compressing the copies over their full surface before they reach the stacking device, scaling up the compressed copies by pushing them a certain way one upon the other, accumulating the scaled-up copies in synchronism with the operation of the stacking device, and transferring the total stack in the pressed condition from the stacking device to the packaging unit where it is enclosed in the wrapping means while the compressed condition is maintained.

As regards the device described above, the object of the invention is achieved by an arrangement characterized in that the stacking device is preceded by a press for the copies, that the loading device comprises first and second conveyor means for the copies and the compressed copies, the conveyor means arranged downstream running at reduced delivery speed and being provided with breaking means operated in synchronism with the stacking device for stopping the compressed copies, and that the transfer means comprise means for gripping and holding the stacked copies under pressure.

This solves the object of the invention fully and perfectly.

The copies are compressed in the loading device over their full surface in order to ensure that any air trapped between the superimposed pages of each copy is removed, and also to smooth the fold and make it more pronounced. The compressed copies can then be fed to the loading device with greater ease and safety.

If the copies are accumulated in the loading device in synchronism with the stacking device, the copies arrange themselves in a scaled-up flow, without any gaps, and the stacking device following the loading device can be charged exactly with the desired counted number of copies, even when the system is operating at very high speed. As a result, the stacks formed by the stacking device always have the same thickness.

The total stack is removed from the stacking device and transferred to the packaging unit in compressed condition. This provides the advantage that the individual copies remain fixed in the total stack even under the effect of shocks or vibrations. Due to the fact that the copies are pressed together, the total stack can be packed into a small package. When the pressing force acting upon the total stack ceases, the wrapping means will expand so that the individual copies will be firmly retained in position.

The first conveyor means may be adapted to the capacity of any preceding machines, without regard to the feeding speed of the second conveyor means. The copies arriving at the loading device one by one are moved on rapidly so as to avoid any jams or other trouble as the copies are received by the packaging device according to the invention. The feeding speed of the second conveyor means may be adjusted in such a manner that the copies arriving from the first conveyor means are combined to a steady flow.

The breaking means arranged before the stacking device serve to block the feed path of the copies between the loading device and the stacking device to enable the copies to be delivered to the stacking device in exactly pre-counted numbers.

The means for gripping the stacked copies grip the total stack in the stacking device while pressing it together to ensure their safe transfer to the packaging device, in properly aligned condition.

According to a preferred embodiment of the invention, the loading device, the stacking device, the transfer device and the packaging device are united to one structural unit.

This permits a compact design of the packaging system according to the invention, and due to the fact that the operations overlap each other in the structural unit short paths are obtained for the copies.

According to a preferred embodiment of the invention, the loading device extends horizontally in the upper area of the constructional unit, while the stacking device operates in downward direction, from the free end of the loading device, and the transfer device extends horizontally below and in parallel, but in opposite sense, to the loading device and is combined with the packaging device to one constructional unit.

This arrangement provides the advantage that the packaging device according to the invention, having a length of approximately two meters and a width of approximately 0.7 meters, is capable of aligning, stacking and packaging the printed matter quickly and safely, while it moves along a short packaging path, whereas the known packaging devices have a length of between three to four meters and a width of approximately one meter.

According to a further improvement of the invention, ejector means are arranged perpendicularly to the transfer sense, in the area of the packaging unit.

This provides the advantage that the packed total stack can be transferred gently and within very limited space to subsequent conveyor means feeding the packed total stack, for example, to a palletizing device.

According to a further improvement of the invention, the first conveyor means and the press are driven by the same drive unit.

This provides the advantage that the press can be operated, by very simple means, with the same delivery speed as the first conveyor means.

According to a further improvement of the invention, the press is provided with two rollers having a length corresponding to the width of the conveyor means and extending transversely to the longitudinal axis of the conveyor means, the spacing between the two rollers being adjustable.

This enables the copies to be compressed over their full surface and any air that may be trapped between the pages or sheets of the copies to be forced out. The pressing force to be exerted upon the copies can be adjusted by varying the spacing between the rollers. However, the spacing between the rollers forming the press may also be increased until the driven lower roller performs only the function of a conveyor element which receives the copies for example from a first conveyor means to transfer them to a second conveyor means.

According to a preferred embodiment of the invention, the braking means are provided on the end of the loading device adjacent the stacking device.

This provides the advantage that no copies can get from the loading device to the stacking device unchecked. If the braking means used consists, for example, of a plate extending across the whole feeding surface of the loading device, the feed path can be blocked or released rapidly, as required.

According to a further improvement of the invention, the loading device is arranged adjacent a first carrier of the stacking device which comprises in addition a second carrier mounted flush below the first carrier.

This provides the advantage that the partial stacks formed in the first carrier can be transferred safely to the second carrier where they are combined to form a total stack.

According to another improvement of the invention, adjustable aligning elements are provided on the carriers. This provides the advantage that the copies can be aligned in the carriers lengthwise and crosswise relative to their broad side, the aligning elements being displaceable and capable of being adapted to the format size of the copies.

According to a further improvement of the invention, the second carrier can be rotated about its vertical axis and comprises rails mounted on a base plate and angle rails that can be displaced perpendicularly thereto, the said rails forming the sides of the cube, and the legs of the angle rails can be pivoted or displaced on at least one side of the said cube.

This provides the advantage that the copies are guided loosely, but safely and retained in aligned condition in the second carrier which is designed in the form of a rotary cage. When the legs on one side of the cube are pivoted or displaced to release the feeding path over the full width of the total stack, then the aligned total stack can be pushed out of the rotary cage.

According to a preferred improvement of the invention, the rails can be displaced away from the base plate, towards the first carrier.

This provides the advantage that the length of fall, and the falling time of the partial stack can be reduced between the first carrier and the second carrier. Accordingly, all partial stacks belonging to one total stack are transferred under the same conditions (falling time, length of fall).

In addition, the transfer device comprises a gripper in the form of at least one pair of gripper arms composed of one rigid and one movable gripper arm arranged in parallel to each other, and the movable gripper arm can be pivoted and/or displaced relative to the rigid gripper arm.

This provides the advantage that the gripper can grip the total stack safely, within very limited space, and transport it in compressed condition. This ensures that light-weight and/or high and narrow stacks remain safely aligned on their further feed path. Depending on the arrangement of the aligning elements on the second carrier, the movable gripper arm is pivoted and/or displaced into its holding position.

According to a further improvement of the invention, the gripper comprises two pairs of gripper arms arranged at a certain distance from each other.

This provides the advantage that the total stack will be guided on its feed path free from distortion. The holding forces of the gripper are distributed evenly over the top and bottom cover sheets of the total stack so that the latter will not be damaged during compression of the total stack. The gripper perform's the functions of guiding, feeding and pressing means. Further, the spaced arrangement of the pairs of gripper arms provides a free space in which, for example, means for packaging the total stack may be arranged.

According to a preferred improvement of the invention, the second carrier coacts with the gripper, which can be displaced in longitudinal and transverse direction relative to the stationary vertical axis of the second carrier, via those sides of the cuboid which exhibit the displaceable or pivoted legs.

This provides the advantage that the total stack remains aligned on its way to a packaging machine, irrespective of any shocks or vibrations. In addition, the total stack can be displaced safely and in a simple manner in vertical direction.

According to a further improvement of the invention, the gripper is provided with switching means for switching on a drive for pivoting or displacing the legs into final positions.

This provides the advantage that the design of both, the gripper and the legs can be adapted more freely to the functions they have to fulfill. When the gripper engages the second carrier, the legs are displaced or pivoted every time they would otherwise hinder the movement of the gripper. In addition, the legs are pivoted or displaced in a manner to clear the feed path as the gripper is moved out of the device. This helps protect the lateral edges of the total stack which are very sensitive to shocks.

According to a further improvement of the invention, a banding device is provided between the pairs of gripper arms.

This provides the advantage that the compressed total stack can be banded within very limited space. The band encloses the total stack particularly tightly and protects it against distortion as the band will expand once the gripper has been opened.

It is understood that the features that have been mentioned before and which will be described in greater detail hereafter can be used not only in their described combinations, but also in any other combination or individually, without leaving the scope of the present invention.

Other advantages of the invention will become apparent from the specification and the attached drawing.

Hereafter, certain embodiments of the invention will be described with reference to the drawing in which FIG. 1 shows a very diagrammatic representation of one packaging device according to the invention illustrating the method according to the invention;

FIG. 2. shows a front view of a gripper of a packaging device according to the invention;

Figure 1:
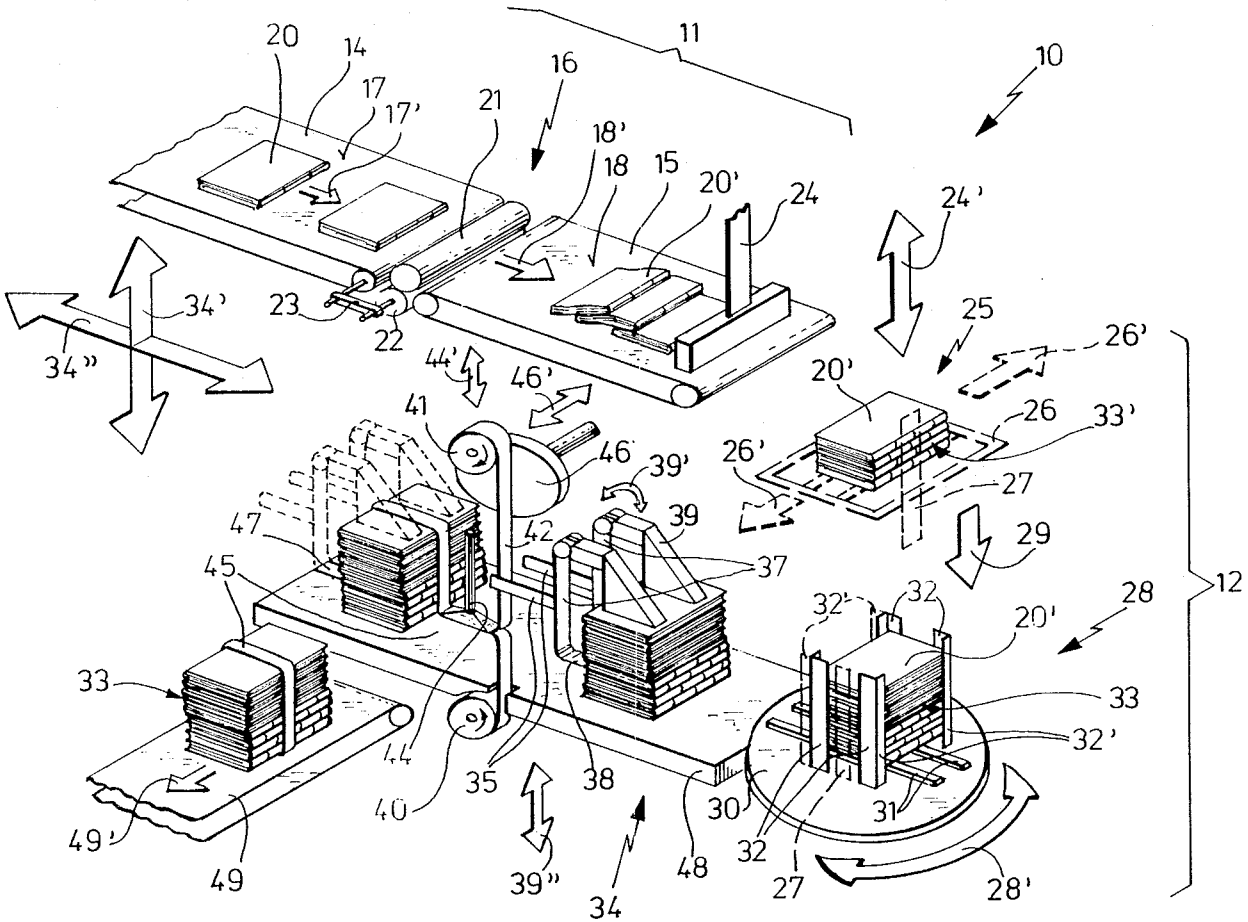

In FIG. 1, the packaging system designated generally by reference numeral 10 and represented in a very diagrammatical manner is composed of a loading device 11, a stacking device 12 and means for packaging printed matter.

The loading device 11 comprises first and second conveyor means 14, 15, for example continuously feeding belt or band conveyors which are interconnected by a press 16. Feeding surfaces 17, 18 of the conveyor means 14, 15 carry copies 20 which are to be transported in the direction indicated by arrows 17', 18'.

The press 16 consists substantially of two rollers 21, 22 whose cylindrical surfaces can be adjusted as regards the distance relative to each other. The roller 22 is driven, for example, by the first conveyor means 14, via a belt 23, as indicated in the drawing. The rollers 21, 22 which extend transversely to the sense of movement of the conveyor means 14, 15 are arranged at a suitable spacing so that the copies 20 arriving from the first conveyor means 14 can be compressed at a pre-selectable force and reach the second conveyor means 15 as copies 20'.

The copies 20 are arranged separately on the first conveyor means 14, while the copies 20' form an uninterrupted flow lying adjacent each other or in overlapping arrangement on the second conveyor means 15.

At the end of the second conveyor means 15, opposite the press 16, there is provided a collecting ram 24 which can be displaced by the usual means in the senses indicated by arrow 24'.

The loading device 11 is immediately followed, in the area of the collecting ram 24, by the stacking device 12 which consists substantially of a pre-stacking cage 25 with pivoted or displaceable bottom forming a first carrier 26, aligning elements 27 and a rotary cage 28.

As indicated in FIG. 1 by dashed lines, aligning elements 27 extending in the direction of the stacking height are provided on all sides of the pre-stacking cage 25 for being adapted to different format sizes of copies 20'. The bottom forming a first carrier 26 which is likewise indicated by dashed lines, is designed as a two-part bottom forming a first carrier 26 which can be displaced in the directions indicated by arrows 26'.

The rotary cage 28 is arranged below the pre-stacking cage 25 in such a manner that the position of the copies 20' in the pre-stacking cage 25 coincides exactly with that in the rotary cage 28. In the condition shown in the drawing, the two-part bottom forming a first carrier 26 blocks the way for the copies 20' in the direction indicated by arrow 29.

As appears from FIG. 1, the rotary cage 28 may consist, for example, of a circular base plate 30, carrying rails 31, angle rails 32 and aligning elements 27. For greater clarity, only one of the aligning elements 27 is illustrated in the figure by dashed lines. The angle rails 32 and aligning elements 27, which can be displaced on the base plate 30, form together a cube,. the base surface of which can be adapted to the format of the copies 20'.

As can be seen, for example, in FIG. 1, the legs of the angle rails 32 can be pivoted into an end position 32', at least on one side of the cube. This side of the rotary cage, i.e. the one with the pivoted legs, is not equipped with any aligning elements 27 between the angle rails 32. As an alternative to the pivoted legs, displaceable legs may be provided, and the base plate 30 may be equipped with grooves, instead of the rails 31.

The whole rotary cage 28 can be rotated about its vertical axis by 180° in the senses indicated by arrow 28'. It is possible in this manner to build up a total stack 33 in the rotary cage 28 by superimposing stacks of copies 20' that have been collected in the pre-stacking cage 25 and have been rotated alternately by 180°. Several copies 20' form a partial stack 33' in the pre-stacking cage 25.

Beside the rotary cage 28 and below the loading device 11, there are provided means for packaging the copies 20'. A gripper 34 which can be guided by guide rods 35 in the senses indicated by arrows 34', 34'', comprises spaced pairs of gripper arms 37 which are designed independently of each other and can be moved in synchronism. FIG. 1 shows two pairs of gripper arms 37 each comprising a rigid gripper arm 38 and a movable gripper arm 39. The movable gripper arm 39 can be pivoted in the senses indicated by arrows 39', 39'' and- /or can be displaced transversely to the rigid gripper arm 38.

The gripper 34 holds the total stack 33 between the rigid and the movable gripper arms 38, 39. The pressing force by which the gripper arms 38, 39 compress the total stack 33 between their arms while the stack is fed to a packaging unit can be freely selected.

Between the spaced pairs of gripper arms 37, rollers 40, 41 are provided in stationary arrangement to support an endless film tape 42 extending transversely to the feeding direction of the total stack 33. A welding die 44 can be displaced in the directions indicated by arrow 44'. In a first end position, it is in contact with a horizontally extending portion of the film tape 42, while in a second end position it is located outside the area where the total stack 33 is moved by the gripper 34.

In its first end position, the welding die 44 acts to separate a band 45 from the film tape 42, to weld the band 45 on the compressed total stack 33 and to weld the film tape 42 together, to form an endless tape.

In the area of the banded total stack 33, there can be seen a die 46 which can be displaced transversely to the horizontal direction of movement of the gripper 34, in the directions indicated by arrow 46'.

In a first end position, when the gripper 34 is opened, it can be pressed against one of those sides of the total stack 33 which are not embraced by the band 45. In its second end position, the die 46 is located outside the area of movement of the total stack 33. The gripper 34, with the rigid gripper arms 38, can be lowered into grooves 47 of a plate 48 so that the total stack 33 comes to rest flat on the surface of the plate 48 when the gripper 34 occupies its open position.

The plate 48 is connected with conventional conveyor means 49 for taking over the banded total stack 33 and feeding it on, for example in the direction indicated by arrow 49'.

The operation of the packaging system 10 illustrated in FIG. 1 is as follows:

The copies 20, which have been processed in folding and/or stitching machines, are delivered individually to the loading device 11. The first conveyor means 14 feeds the copies 20 at a speed, which is adapted to the folding or stitching machine, to the press 16 which pushes the compressed copies 20' upon the second conveyor means 15. The first conveyor means 14 and the press 16 operate at the same delivery rate, while the second conveyor means 15 operates at a rate lower than that of the first conveyor means 14.

On the second conveyor means 15, the copies 20' get closer to each other or are scaled up to form a continuous flow. The scaled copies which advance continuously on the conveyor means 15 can be piled up by means of a collecting ram 24. To this end, the collecting ram 24 is lowered from the top to the surface 18 of the conveyor means until the gap between the conveyor means 15 and the collecting ram 24 is smaller than the thickness of one copy 20'.

Every time the two-part bottom forming a first carrier 26 of the pre-stacking cage 25 is in the closed position, the pre-stacking cage 25 of the stacking device 12 is loaded with copies 20'. The collecting ram 24 is raised a sufficient length to ensure that the scaled flow of copies can pass freely through the gap between the conveyor surface 18 and the collecting ram 24. In the pre-stacking cag 25, the copies 20' are aligned and a partial stack 33' is formed from a pre-counted number of copies 20'. Once the number of copies 20' forming one partial stack 33' has been reached, the scaled copies arriving continuously on the second conveyor means 15 are piled up, the two-part bottom forming a first carrier 26 is opened in the direction indicated by arrow 26', and the partial stack 33' is permitted to drop by gravity into the rotary cage forming a second carrier 28.

Figure 4:
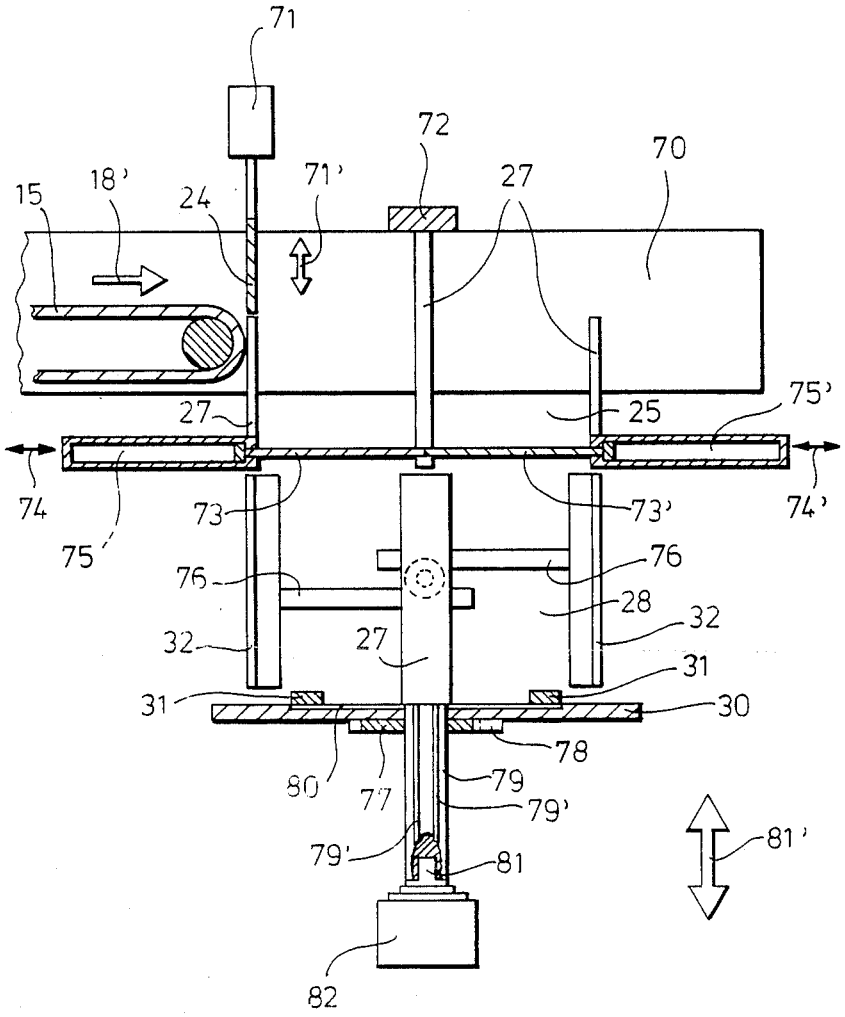
FIG. 4 shows a cross-section through a stacking device of packaging device according to the invention.

During this operation, the bottom of the rotary cage 28 may be raised, as shown in FIG. 4, so as to reduce the length of fall between the pre-stacking cage 25 and the rotary cage 28. In the rotary cage 28, the partial stack 33' is aligned once more and rotated by 180° about its vertical axis. Simultaneously, another partial stack 33 is formed in the pre-stacking cage 25 which then drops upon the partial stack 33' already present in the rotary cage 28 when the bottom forming a first carrier 26 is opened again. Several such partial stacks 33' are combined in the rotary cage 28 to form a total stack 33. The folds and/or stitched backs of the copies 20' of the partial stacks 33' are arranged diametrically opposite each other in the rotary cage 28.

Once the desired total height of the stack has been reached, the gripper 34 advances with its pairs of gripper arms 37 into the rotary cage 28. During this movement, the rigid gripper arms 38 slide into a position below the total stack 33 while the movable gripper arms 39 come to rest upon the surface of the total stack 33. The pairs of gripper arms 37 compress the total stack 33 between their gripper arms 38, 39 and move the aligned total stack 33 out of the rotary cage 28. During this movement, the legs of the angle rails 32 located on the side by which the grippers 34 engage the rotary cage 28, are pivoted into a position which makes the feed path of the total stack 33 free from any obstacles, as the gripper leaves the rotary cage 28. The gripper 34 can feed the total stack 33 horizontally, along the direction of engagement of the rotary cage 28, and transversely thereto, as indicated by arrows 34', 34''.

The gripper 34 moves the total stack 33 out of the area of rotation of the rotary cage 28, guiding the total stack 33 simultaneously through a curtain formed by the film tape 42. During this movement of the gripper 34, the compressed total stack 33 is banded by the film tape 42. Thereafter, the film tape 42 is welded by conventional means to form a band 45 around the compressed total stack 33. The band 45 is separated from the film tape 42, and the latter is welded together between the rollers 40, 41 to form again an endless tape.

Once the total stack 33 has been banded, the movable gripper arms 39 open, the height of the total stack increases slightly as the compression force of the gripper arms 38, 39 is removed, and the band 45 expands so as to retain the total stack 33 safely in position, and free from distortion.

In the open position of the gripper 34, the banded total stack 33 rests on the rigid gripper arms 38, or the gripper 34 is lowered in the direction indicated by arrow 43' so that the rigid gripper arms 38 engage grooves 47 in the plate 48 to form a level surface, flush with the plate 48.

Thereupon, the banded total stack 33 is pushed out of the gripper 34 and upon the conveyor means 49 by the ram 46.

Thereafter, the gripper 34 enters again the rotary cage 28—the pairs of grippers 37 passing by the film tape 42, which has been welded together again to form an endless tape, on its two sides—picks up the next aligned total stack 33, compresses it and feeds it again to the banding position.

For the sake of clarity, FIG. 1 shows no drives for the conveyor means 14, 15, the press 16, the collecting ram 24, the bottom forming a first carrier 26, the rotary cage 28, the pivoted and/or displaceable angle rails 32, the gripper 34, the welding die 44, the ram 46 and the conveyor means 49. The different devices may be driven either by electric or pneumatic means. In addition, there is also a possibility to provide automatic adjusting means for the aligning elements 27 and the angle rails 32.

Figure 2:
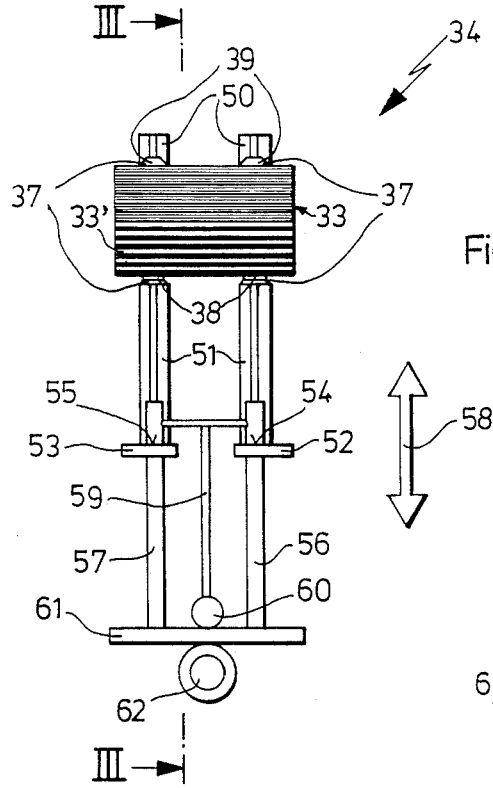

FIG. 2 shows a front view of one embodiment of a gripper 34 according to the invention in the position in which a total stack 33 is held in guided and compressed condition, for being delivered.

In the illustration of FIG. 2, the gripper 34 holds a total stack 33 composed of two partial stacks 33'. The gripper arms 38, 39 are combined to two pairs of gripper arms 37 forming part of a frame 50 which is fixed to supporting members 51. The ends of the supporting members 51 opposite the frame 50 are fixed to a plate 52, 53 provided with bores 54, 55 passed by rods 56, 57. The plates 52, 53 can be displaced by means of a linkage 59 along the rods 56, 57 in the direction indicated by arrow 58. The linkage 59 is connected to the supporting elements 51 of the two pairs of gripper arms 37 and is displaced by a piston coacting with a cylinder 60 so that the two pairs of gripper arms 37 are displaced synchronously. The rods 56, 57 and the cylinder 60 are mounted on a plate 61 that can be displaced in the longitudinal direction of a bar 62.

Figure 3:
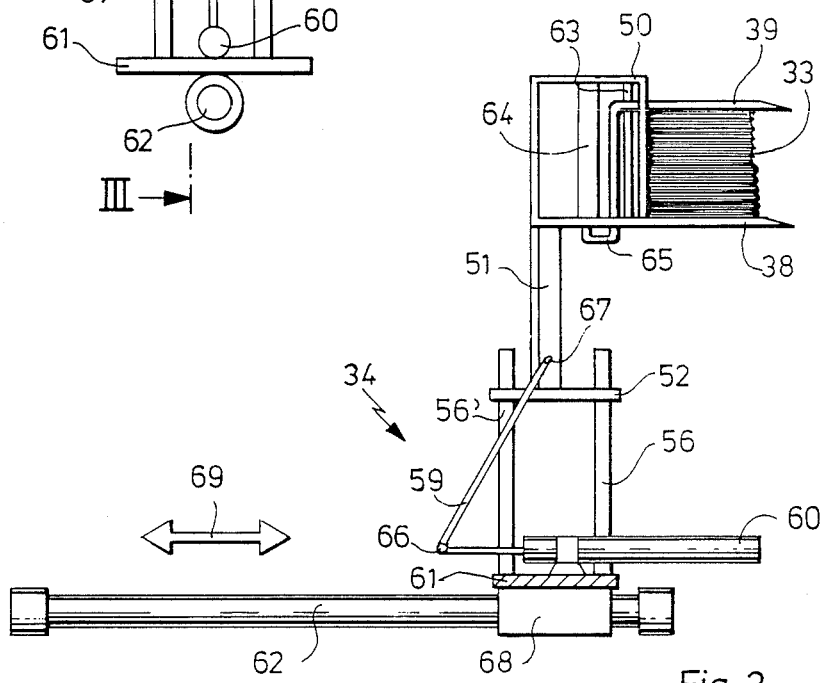
FIG. 3 shows a section taken along line III—III in FIG. 2.

FIG. 3 shows a cross-section through the gripper 34 taken along line III—III in FIG. 2.

The total stack 33 is held in compressed condition by the gripper arms 38, 39. The rigid gripper arm 38 is formed integrally with the frame 50, while in the example shown the movable gripper arm 39 can be displaced only along a guide rod 63. In addition to the guide rod 63, a cylinder 64 is arranged inside the frame 50. The cylinder 64 coacts with a piston 65 serving to displace the movable gripper arm 39 along the guide rod 63. The supporting element 51 is connected with the frame 50, the plate 52 and the linkage 59. The linkage 59 comprises joints 66, 67 which serve to translate the horizontal movement of a piston guided in the cylinder 60. A bushing 68 enables the plate 61 to be displaced along the bar 62 in the senses indicated by arrow 69.

FIG. 4 shows a longitudinal section through a detail of the loading device 11, the pre-stacking cage 25 and the rotary cage 28.

The second conveyor means 15 which runs in the direction indicated by arrow 18' is arranged adjacent the plate-shaped collecting ram 24 and an aligning element 27 of the pre-stacking cage 25. The second conveyor means 15 is mounted laterally on a wall 70. The collecting ram 24 can be moved out of and retracted into a housing 61, in the senses indicated by arrow 71'. In the position represented in the drawing, the collecting ram 24 blocks the entire feed path of the second conveyor means 15. A supporting element 72 mounted on the wall 70 carries displaceable aligning elements 27. The bottom of the pre-stacking cage 25 is closed by a bottom element or carrier consisting of two sliding plates 23, 23'. The sliding plates 23, 23' can be displaced in housings 75, 75' in the senses indicated by arrows 74, 74'. Beneath the pre-stacking cage 25, the angle rails 32 and the aligning elements 27 of the rotary cage 28 are arranged flush with the aligning elements 27 of the pre-stacking cage 25. In the case of the embodiment shown, the aligning elements 27 of the rotary cage 27 are mounted by their one ends on the base plate 30. The angle rails 32 are mounted on the aligning elements 27 via rods 76, for being displaced relative to the aligning elements 27.

The bottom face of the base plate 30 carries a toothed wheel 77 which is engaged by a toothed rod 78 by which the base plate 30 can be rotated about its vertical axis. The toothed wheel 78 is passed by a shaft 79 with grooves 79' which engage keys provided on the inside of the annular surface of the toothed wheel 77. One end of the shaft 79 carries supporting elements 80 which are recessed over their full length into the base plate 30 so that their surfaces end flush with the latter. The rails 31, which project beyond the surface of the base plate, are fixed to the other ends of the supporting elements 80.

The end of the shaft 79 opposite the base plate 40 is provided with a recess which is engaged by a stud 81 of a cylinder 42 that can be moved in the senses indicated by arrow 81'. The shaft 79 is seated rotatably on the cylinder 82.

Now, when the cylinder moves in the direction of the pre-stacking cage 25, the rails 31 are likewise displaced in the same direction, and the length of fall which the copies have to traverse between the pre-stacking cage 25 and the rotary cage 28 is reduced.

Figure 5:
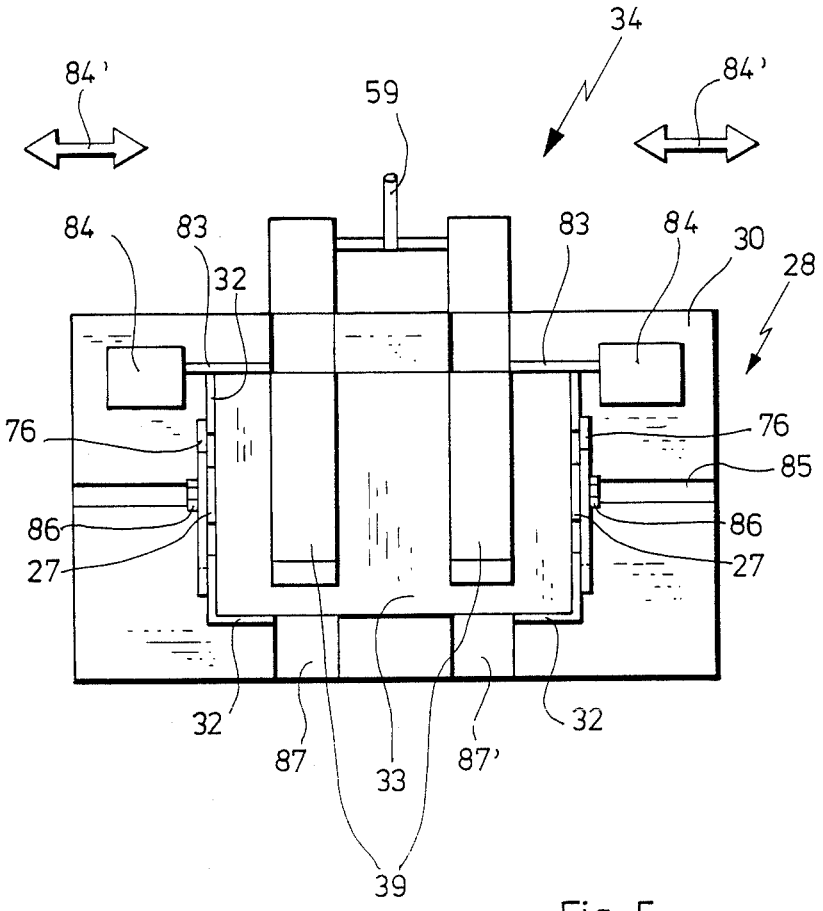
FIG. 5 shows a top view of a rotary cage of a packaging device according to the invention.

FIG. 5 shows a top view of a detail of the gripper 34 in the rotary cage 28 of the packaging system according to the invention.

It can be seen that the aligning elements 27 and the angle rails 37 are arranged along the cuboid total stack 33 on the base plate 30 which in this case exhibits a rectangular arrangement. The legs 83 of the angle rails 32 located on the side of the cuboid by which the gripper 34 engages the rotary cage 28, are arranged for displacement in a housing 84. Once the gripper 34 releases a contact as it approaches the rotary cage 28, for instance by interrupting the measuring circuit of a light barrier, the legs 83 can slide in the directions indicated by arrows 84', whereupon the legs 83 are retracted into the housing 84 until the movable gripper arms 39 can be advanced unhindered into a closed position of the gripper 34 in which the total stack 33 is retained by the gripper 34 in compressed condition and moved out of the rotary cage 28.

The base plate 30 is provided with a first guide groove 85 for adjusting the aligning elements 27 on which the rods 76 of the angle rails 32 are mounted by a screw connection, for being displaced thereon. Further, two additional guide grooves 87, 87' are provided on the base plate 30 for the rigid gripper arms 38.

We claim:

1. Apparatus for packaging preferably folded, glued or stitched copies of printed matter, comprising loading means adapted for receiving the copies from a preceding station, said loading means comprising first conveyor means for conveying the copies, a press for pressing the copies, and second conveyor means for conveying the compressed copies; said second conveyor means running at reduced delivery speed and being provided with braking means operating in synchronism with stacking means for stopping the compressed copies, said stacking means following the loading means; and transfer means for transferring stacked copies from said stacking means to a packaging unit, said transfer means comprising means for gripping and holding the stacked copies received within said stacking means, said means for gripping and holding hold and grip said stacked copies under pressure during transferring said stack from said stacking means to said packaging unit.

2. Apparatus according to claim 1, wherein said loading means, said stacking means, said transfer means and said packaging unit are united to one constructural unit.

3. Apparatus according to claim 2, wherein said loading means extends horizontally in the upper area of said constructional unit, while said stacking means operates in downward direction from the free end of said loading means, and said transfer means extends horizontally below and in parallel, but in opposite sense, to the said loading means and is combined with the said packaging unit to one constructional unit.

4. Apparatus according to claim 3, wherein ejector means are arranged perpendicularly to the transfer sense, in an area of the said packaging unit.

5. Apparatus according to claim 1, wherein said first conveyor means and said press are driven by a same drive unit.

6. Apparatus according to claim 5, wherein said press is provided with two rollers having a length corresponding to the width of said conveyor means and extending transversely to the longitudinal axis of said conveyor means, the spacing between the two rollers being adjustable.

7. Apparatus according to claim 1, wherein said braking means are provided on an end of said loading means adjacent to said stacking means.

8. Apparatus according to claim 1, wherein said loading means is arranged adjacent to a first carrier of said stacking means which comprises in addition a second carrier mounted flush below said first carrier.

9. Apparatus according to claim 8, wherein adjustable aligning elements are provided on said first and second carriers.

10. Apparatus according to claim 9, wherein said second carrier can be rotated about its vertical axis and comprises rails mounted on a base plate and angle rails that can be displaced perpendicularly thereto, said rails forming sides of a cube, and legs of said angle rails can be displaced on at least one side of said cube.

11. Apparatus according to claim 10, wherein said rails can be displaced away from said base plate, towards said first carrier.

12. Apparatus according to claim 11, wherein said transfer means comprises a gripper in the form of at least one pair of ripper arms composed of one rigid and one movable ripper arm arranged in parallel to each other, and said movable ripper arm can be displaced relative to the rigid gripper arm.

13. Apparatus according to claim 12, wherein said gripper comprises two pairs of ripper arms arranged at a certain distance from each other.

14. Apparatus according to claim 13, wherein said second carrier coacts with said gripper, which can be displaced in longitudinal and transverse direction relative to the stationary vertical axis of said second carrier, via those sides of the cube which exhibit the displaceable legs.

15. Apparatus according to claim 14, wherein said gripper is provided with switching means for switching on a drive for displacing said legs into final positions.

16. Apparatus according to claim 15, wherein a banding device is provided between said pairs of gripper arms.

* * * * *